US007233300B2

(12) United States Patent
Kwon et al.

(10) Patent No.: US 7,233,300 B2
(45) Date of Patent: Jun. 19, 2007

(54) APPARATUS AND METHOD FOR DISPLAYING GRAY SCALES OF PLASMA DISPLAY PANEL

(75) Inventors: Tae-Kyong Kwon, Cheonan (KR); Im-Su Choi, Yangsan (KR)

(73) Assignee: Samsung SDI Co., Ltd., Suwon (KR)

( * ) Notice: Subject to any disclaimer, the term of this patent is extended or adjusted under 35 U.S.C. 154(b) by 992 days.

(21) Appl. No.: 10/210,110

(22) Filed: Aug. 2, 2002

(65) Prior Publication Data

US 2003/0058476 A1 Mar. 27, 2003

(30) Foreign Application Priority Data

Sep. 25, 2001 (KR) ..... 2001-59406

(51) Int. Cl.
*G09G 3/28* (2006.01)

(52) U.S. Cl. ..... 345/63; 345/60; 345/62; 345/67; 345/690

(58) Field of Classification Search ..... 345/63, 345/60, 62, 67, 690
See application file for complete search history.

(56) References Cited

U.S. PATENT DOCUMENTS 6,690,388 B2 * 2/2004 Kasahara et al. ..... 345/690

* cited by examiner

*Primary Examiner*—Richard Hjerpe
*Assistant Examiner*—Leonid Shapiro
(74) *Attorney, Agent, or Firm*—H.C. Park & Associates, PLC

(57) ABSTRACT

The apparatus for displaying plasma display panel (PDP) gray scales includes an automatic power controller for detecting an average signal level (ASL) in each field of video data; first and second frame memories for storing the video data in even and odd frames; a sub-field generator for mapping the video data according to the number of sub-fields, generating gray scale data, and selectively storing them in the frame memories; an address data generator for generating address data and applying them to the PDP; an ASL controller for comparing the numbers of sub-fields in each field with each other, and controlling the number of sub-fields; and a sustain scan pulse generator for receiving the number of sub-fields, generating sustain pulses and scan pulses, and applying them to the PDP.

2 Claims, 9 Drawing Sheets

APPARATUS AND METHOD FOR DISPLAYING GRAY SCALES OF PLASMA DISPLAY PANEL

BACKGROUND OF THE INVENTION

1. Field of the Invention

The present invention relates to a plasma display panel (PDP). More specifically, the present invention relates to an apparatus and a method for displaying gray scales of a PDP, which are capable of reducing the generation of flickering and a pseudo-outline during the displaying of gray scales of a moving picture.

2. Description of the Related Art

A PDP is a kind of a display device for recovering input picture data from an electric signal by arranging a plurality of discharge cells in the form of a matrix and selectively radiating the discharge cells.

The PDP can display gray scales so as to function as a color display device. A gray scale display method for dividing a field into a plurality of sub-fields with time divisions controlling the sub-fields is used.

In a common gray scale display method, the number of sub-fields is fixed regardless of video data. In a method for displaying gray scales using a variable sub-field method, the number of sub-fields is determined according to the average signal level (ASL) of a video signal of one field. Input video data are mapped and stored in a field memory according to the determined number of sub-fields. Because the ASL is determined only when all of the video data of a field are input, a field memory for storing the data is necessary while the ASL of continuously input video data is determined. Therefore, the continuously input video data are mapped by sub-field by the ASL determined in a previous field and are stored in the field memory. The data stored in the field memory are read in a next field and are sustained according to the currently determined ASL.

FIG. 1 is a block diagram of a gray display apparatus using a variable sub-field method in a conventional PDP.

As shown in FIG. 1, the gray scale display apparatus using the variable sub-field method includes a video signal processor 10, a gamma correction and error diffusion unit 20, an automatic power controller 30, first and second field memories 40 and 50, a sub-field generator 60, first and second frame memories 70 and 80, an address data generator 90, and a sustain scan pulse generator 100.

The video signal processor 10 digitalizes a video signal input received from the outside and generates digital video data.

The gamma correction and error diffusion unit 20 receives the digital video data output from the video signal processor 10, corrects a gamma value according to the characteristics of a PDP 110, diffuses a display error with respect to peripheral pixels, and outputs the digital video data.

The automatic power controller 30 selectively stores the video data output from the gamma correction and error diffusion unit 20 in the first and second field memories 40 and 50 according to whether the video data are even field data or odd field data, and detects the ASL of the respective video data. The ASL can be determined after the video data are stored in the field memories 40 and 50.

The sub-field generator 60 selectively stores the video data output from the automatic power controller 30 in the first and second frame memories 70 and 80 and generates gray scale data corresponding to the respective video data.

The address data generator 90 generates address data corresponding to the gray scale data output from the sub-field generator 60 and applies the address data to the address electrodes A1, A2, . . . and Am of the PDP 110.

The sustain scan pulse generator 100 receives the ASL output from the automatic power controller 30, generates sustain pulses and scan pulses, and applies the sustain pulses and the scan pulses to the scan electrodes X1, X2, . . . and Xn and to the sustain electrodes Y1, Y2, . . . and Yn of the PDP 110.

FIG. 2 schematically shows a method for displaying gray scales using a variable sub-field method in a conventional PDP.

As shown in FIGS. 1 and 2, (n−1)th field data $D_{n-1}$ is input to the first field memory 40 through the automatic power controller 30 in a (n−1)th field. The ASL of the (n−1)th field data $D_{n-1}$, that is, $ASL_{n-1}$, is determined by the automatic power controller 30 at the point of time when the input of the (n−1)th field data $D_{n-1}$ is completed, that is, when the (n−1)th field data $D_{n-1}$ is stored in the first field memory 40. $ASL_n$, that is, the ASL of nth field data $D_n$, and $ASL_{n+1}$, that is, the ASL of (n+1)th field data $D_{n+1}$, are determined by the method used for determining the $ASL_{n-1}$.

The field data $D_{n-1}$, $D_n$, and $D_{n+1}$ are divided into even field data and odd field data and are alternately stored in the first field memory 40 and the second field memory 50. The field data $D_{n-1}$, $D_n$, and $D_{n+1}$ are sub-field mapped by the ASL determined in a previous field by the sub-field generator 60 and are stored in the corresponding frame memories 70 and 80.

For example, the nth field data $D_n$ is sub-field mapped according to the number of sub-fields, which is determined by the $ASL_{n-1}$ determined in the (n−1)th field, and is stored in the first frame memory 70. The (n+1)th field data $D_{n+1}$ is sub-field mapped according to the number of sub-fields, which is determined by the $ASL_n$ determined in the nth field, and is stored in the second frame memory 80.

In each field, data stored in a previous field are read and a sustain operation is performed on the PDP 110 according to the number of sub-fields, which is determined by the ASL determined in the previous field.

For example, in the nth field, the (n−1)th field data $D_{n-1}$ stored in the first frame memory 70 is read from the (n−1)th field and the sustain operation is performed according to the number of sub-fields, which is determined by the $ASL_{n-1}$ determined in the (n−1)th field. In the (n+1)th field, the nth field data $D_n$ stored in the second frame memory 80 is read from the nth field and the sustain operation is performed according to the number of sub-fields, which is determined by the $ASL_n$ determined in the nth field.

With reference to the nth field data $D_n$ stored in the second frame memory 80 in the nth field, meanwhile, the second frame memory 80 is sub-field mapped according to the number of sub-fields determined by the ASL determined in the (n−1)th field that is a previous field, that is, the $ASL_{n-1}$, and the sustain operation is performed in the (n+1)th field. Therefore, the sustain operation is performed according to the number of sub-fields, which is determined by the ASL determined in a previous field, that is, the $ASL_n$.

In the variable sub-field method, the sub-field mapping is performed in a different way according to the ASL of the video data. For example, when the ASL is 33, 10 sub-fields are mapped. When the ASL is 34, 11 sub-fields are mapped, and so on. This is depicted in FIGS. 3 and 4.

In the variable sub-field method, when the ASL of an adjacent pixel corresponds to the boundary where the sub-field mapping varies, that is, the ASLs of adjacent pixels are 33 and 34 with reference to the above example, (see FIGS. 3 and 4) the ASL applied when the field memory is stored is different from the ASL applied when the sustain operation is performed on the field data. Accordingly, an undesirable screen flickering phenomenon occurs.

SUMMARY OF THE INVENTION

It is an object of the present invention to provide an apparatus and a method for displaying gray scales of a PDP, which are capable of displaying gray scales using a variable sub-field method in a PDP without adopting a field memory using the fact that a correlation of video signals among frames is high.

In one aspect of the present invention, there is provided an apparatus for displaying gray scales of a PDP, by which gray scales are displayed by arranging a plurality of sub-fields having brightness weights in the order of time and the number of sub-fields is determined according to a ASL of video data, the apparatus comprising: an automatic power controller for detecting an ASL in each field of video data; first and second memories for storing the video data in even frames and odd frames; a sub-field generator for mapping the video data output from the automatic power controller according to the number of sub-fields that is determined by the ASL detected by the automatic power controller, generating corresponding gray scale data, and selectively storing the gray scale data in the first and second memories; an address data generator for generating address data corresponding to the gray scale data output from the sub-field generator and applying the address data to the plasma display panel; an ASL controller for comparing the numbers of sub-fields that are determined by the ASL in each field output from the automatic power controller with each other and controlling the output number of sub-fields; and a sustain scan pulse generator for receiving the number of sub-fields that is controlled by and output from the ASL controller, generating corresponding sustain pulses and scan pulses, and applying the sustain pulses and scan pulses to the PDP.

The sub-field generator maps the video data of the current field according to the number of sub-fields that is determined by the ASL of previous field video data, and stores the video data of the current field in either the first memory or the second memory.

The ASL controller receives the current field output from the automatic power controller, determines the number of corresponding sub-fields, compares the number of corresponding sub-fields with the number of sub-fields that is determined by the ASL of a previous field, outputs the number of sub-fields that is determined by the ASL of the current field to the sustain scan pulse generator when the number of sub-fields that is determined by the ASL of the previous field is equal to the number of sub-fields that is determined by the ASL of the current field, and outputs the number of sub-fields that is determined by the ASL of the previous field to the sustain scan pulse generator when the number of sub-fields that is determined by the ASL of the previous field is different from the number of sub-fields that is determined by the ASL of the current field.

In another aspect of the present invention, there is provided a method for displaying gray scales of a PDP, by which gray scales are displayed by arranging a plurality of sub-fields having brightness weights in the order of time and the number of sub-fields is determined according to a ASL of video data, the method comprising: (a) detecting the ASL of the video data of the current field; (b) mapping the video data of the current field according to the number of sub-fields that is determined by the ASL of the previously detected video data of a previous field, and storing the video data of the current field; (c) comparing the number of sub-fields that is determined by the ASL of the video data of the current field with the number of sub-fields that is determined by the ASL of the video data of the previous field, and controlling the output number of sub-fields; and (d) applying the video data of the current field, which are stored in the step (b), to the PDP and generating sustain scan pulses according to the number of sub-fields, which is controlled in the step (c), and applying the sustain scan pulses to the PDP, at the same time.

In another aspect of the present invention, there is provided a method for displaying gray scales of a PDP, by which gray scales are displayed by arranging a plurality of sub-fields having brightness weights in the order of time, and the number of sub-fields is determined according to a ASL of video data. In the method, when pairs of continuous specific field data among the video data are positioned on a boundary where the number of sub-fields that is determined by each ASL varies, the pairs of specific field data are mapped according to the number of sub-fields that is determined by the ASL of a pair of field data previously processed among the pairs of specific field data, and they are applied to the PDP, and sustain scan pulses applied to the PDP are generated according to the number of sub-fields that is determined by the ASL of the previously processed pair of field data, at the same time.

BRIEF DESCRIPTION OF THE DRAWINGS

The accompanying drawings, which are incorporated in and constitute a part of the specification, illustrate an embodiment of the invention, and, together with the description, serve to explain the principles of the invention, in which.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 5:
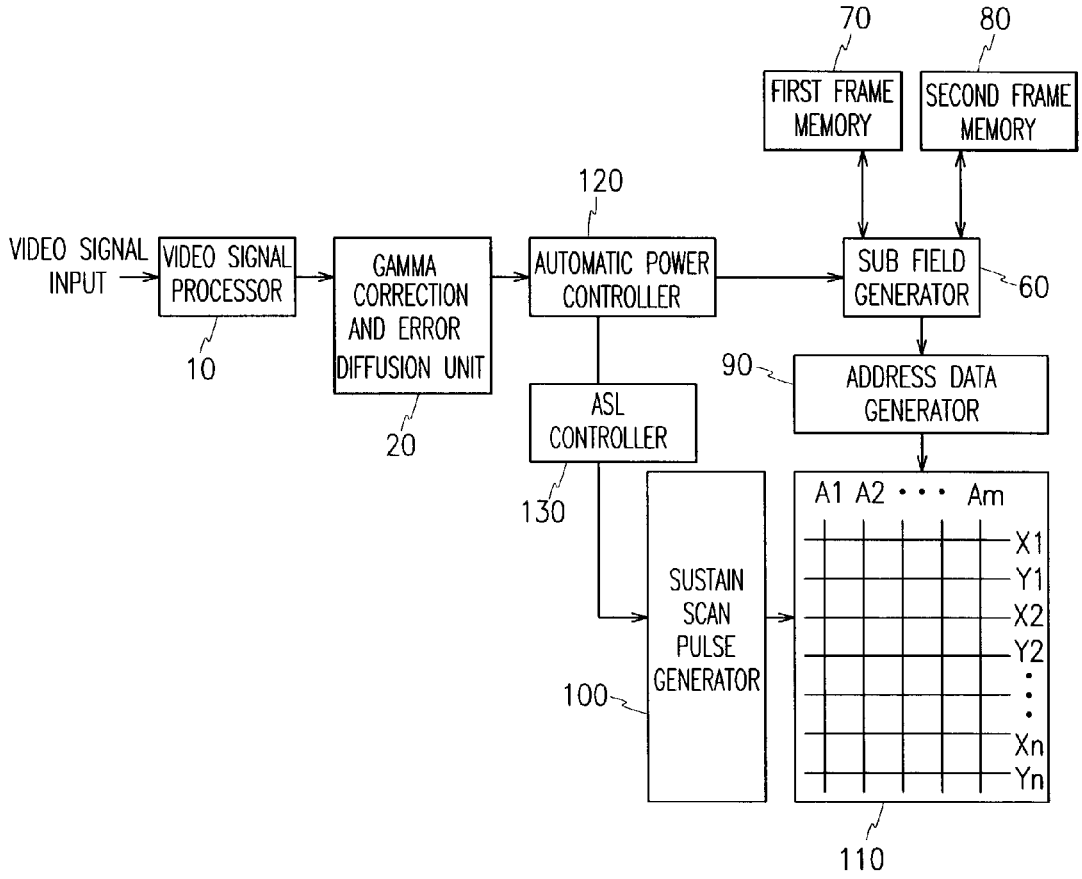
FIG. 5 is a block diagram of an apparatus for displaying gray scales using the variable sub-field method in the PDP according to an embodiment of the present invention.

FIG. 5 is a block diagram of an apparatus for displaying gray scales using a variable sub-field method in a PDP according to an embodiment of the present invention.

Figure 1:
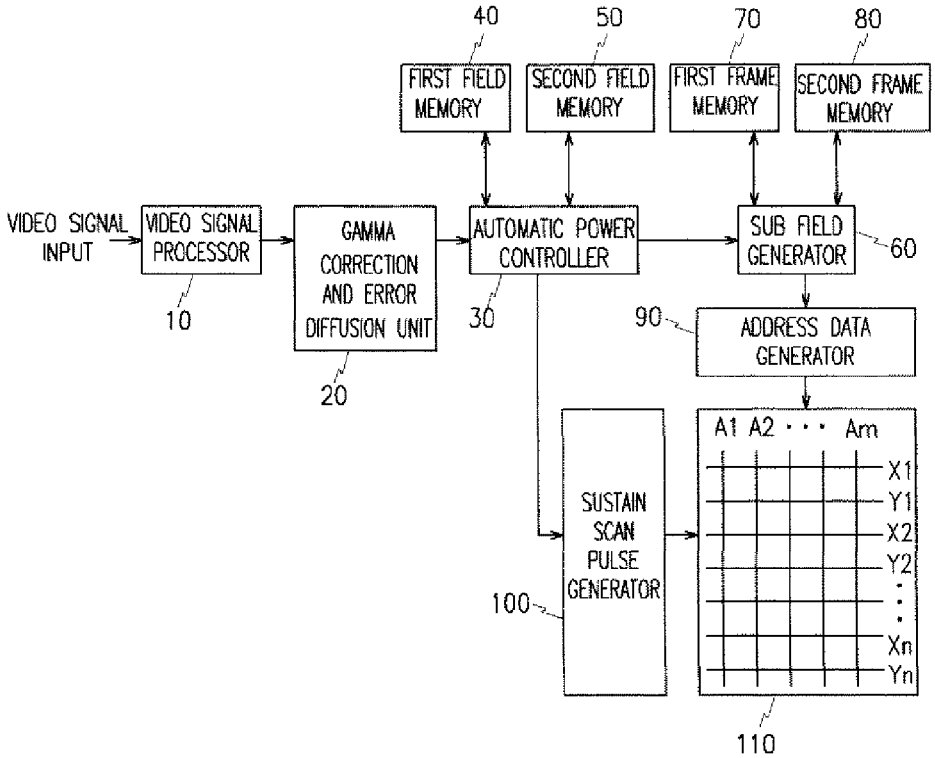
FIG.1(Prior Art)
FIG. 1 is a block diagram of an apparatus for displaying gray scales using a variable sub-field method in a conventional PDP.
Figure 2:
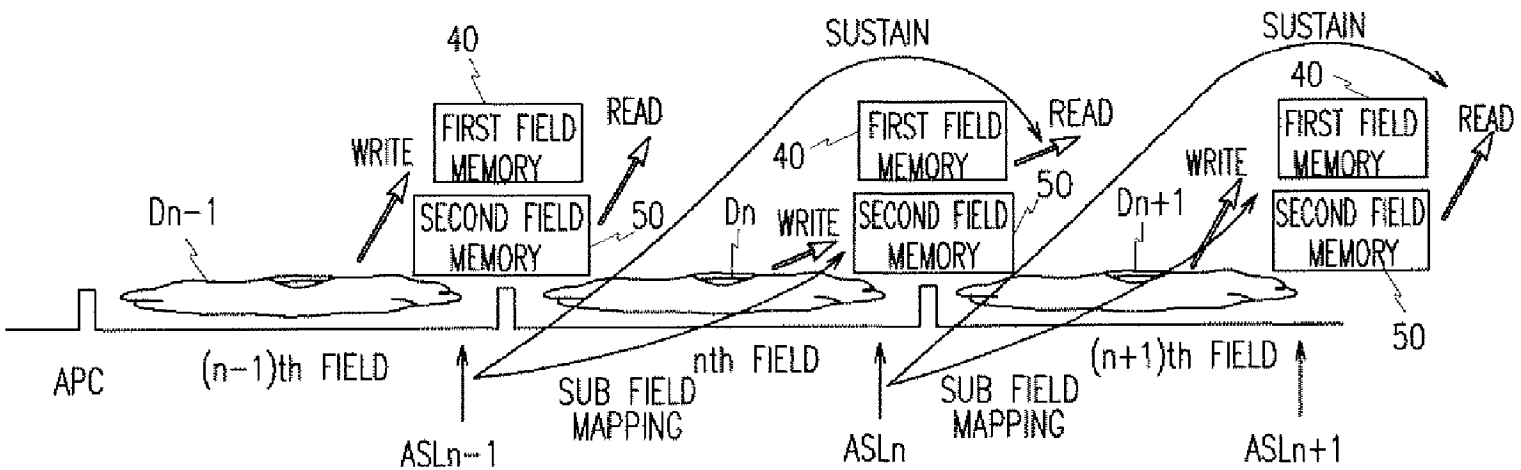
FIG.2(Prior Art)
FIG. 2 schematically shows a method for displaying gray scales using the variable sub-field method in the conventional PDP.
Figure 3:
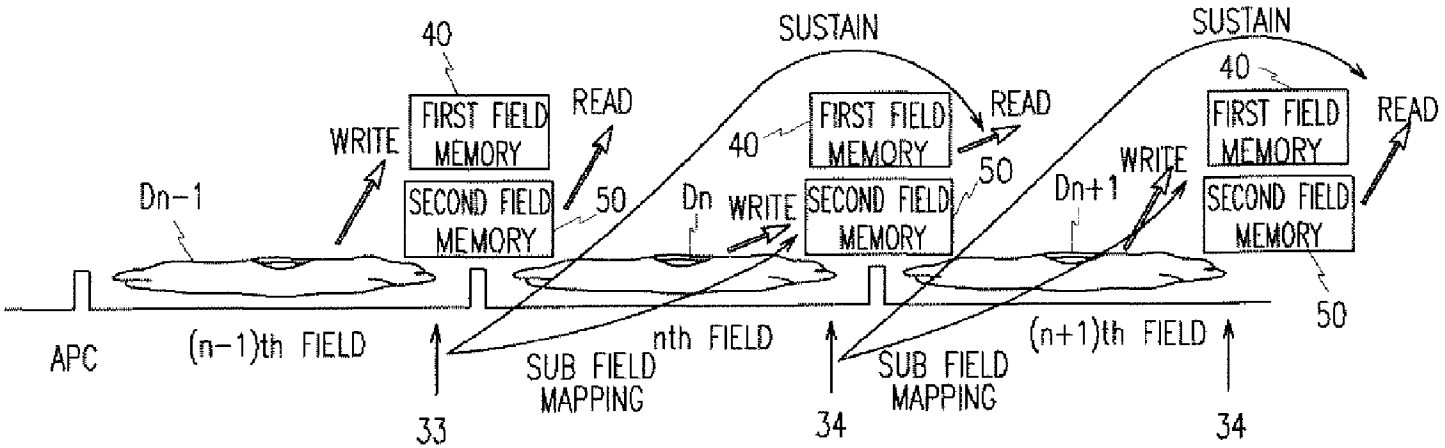
FIG.3(Prior Art)
FIG. 3 schematically shows an example of the method for displaying gray scales using the variable sub-field method in the conventional PDP.
Figure 4:
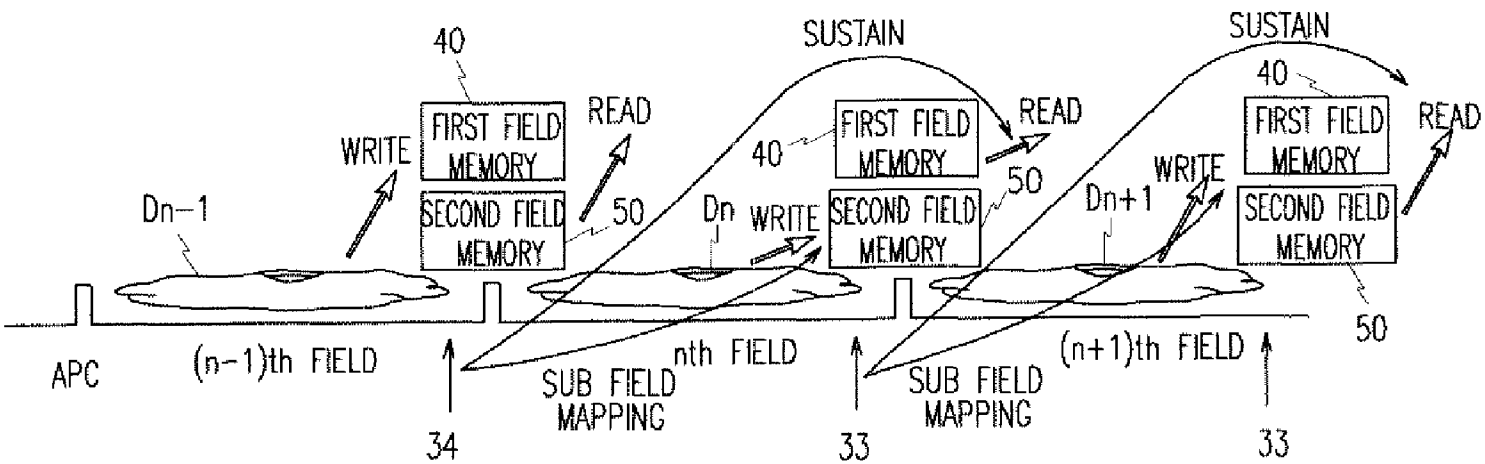
FIG.4(Prior Art)
FIG. 4 schematically shows another example of the method for displaying gray scales using the variable sub-field method in the conventional PDP.

In FIG. 5, the same reference numerals 10 and 20 will be used with respect to the video signal processor and the gamma correction and error diffusion unit that perform the same functions as those of the elements of FIG. 1.

As shown in FIG. 5, the apparatus for displaying gray scales according to the embodiment of the present invention includes the video signal processor 10, the gamma correction and error diffusion unit 20, an automatic power controller 120, a sub-field generator 60, an ASL controller 130, first and second frame memories 70 and 80, an address data generator 90, and a sustain scan pulse generator 100.

The video signal processor 10 digitalizes a video signal input received from the outside, to thus generate digital video data. The gamma correction and error diffusion unit 20 receives the digital video data output from the video signal processor 10, corrects a gamma value according to the characteristics of a PDP 110, diffuses a display error with respect to peripheral pixels, and outputs the digital video data.

The automatic power controller 120 directly transmits the video data output from the gamma correction and error diffusion unit 20 to the sub-field generator 60, unlike in a conventional technology where the video data are stored in two field memories and the ASL of the corresponding video data is detected. That is, the conventional field memory is not used in an embodiment of the present invention.

The sub-field generator 60 selectively stores the video data output from the automatic power controller 120 in the first and second frame memory 70 and 80, and generates gray scale data corresponding to the respective video data.

The address data generator 90 generates address data corresponding to the gray scale data output from the sub-field generator 60, and applies the address data to the address electrodes A1, A2, . . . and Am of the PDP 110.

The ASL controller 130 compares the number of sub-fields that is determined by the ASL output from the automatic power controller 120 with the number of sub-fields that is determined by the ASL of previous field data. The ASL controller 130 ignores the number of sub-fields that is determined by the current ASL when the number of sub-fields that is determined by the ASL of the previous field data is not equal to the number of sub-fields that is determined by the current ASL, and outputs the number of sub-fields that is determined by the ASL of the previous field data.

The sustain scan pulse generator 100 receives the number of sub-fields that is controlled by and output from the ASL controller 130, generates corresponding sustain pulses and scan pulses, and applies the generated sustain pulses and scan pulses to the sustain electrodes X1, X2, . . . and Xn and to the scan electrodes Y1, Y2, . . . and Yn of the PDP 110.

Figure 6:
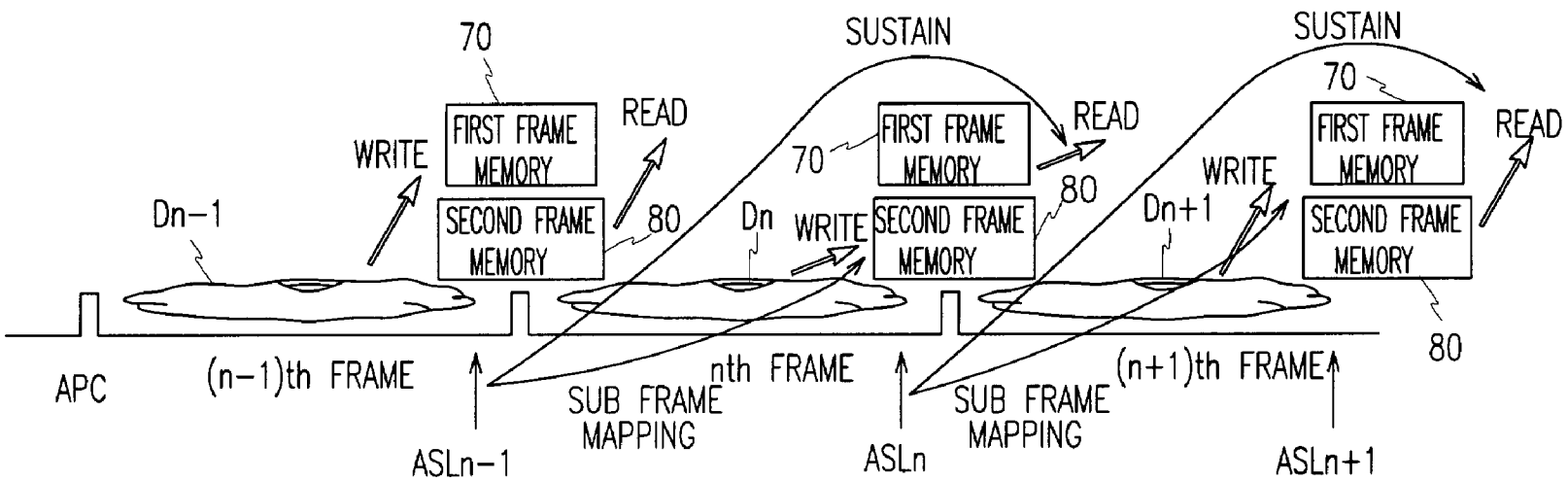
FIG. 6 schematically shows that the number of sub-fields is not controlled in a method for displaying gray scales using the variable sub-field method in the PDP according to an embodiment of the present invention.

FIG. 6 schematically shows a method for displaying gray scales using the variable sub-field method in the PDP according to the embodiment of the present invention.

Figure 7:
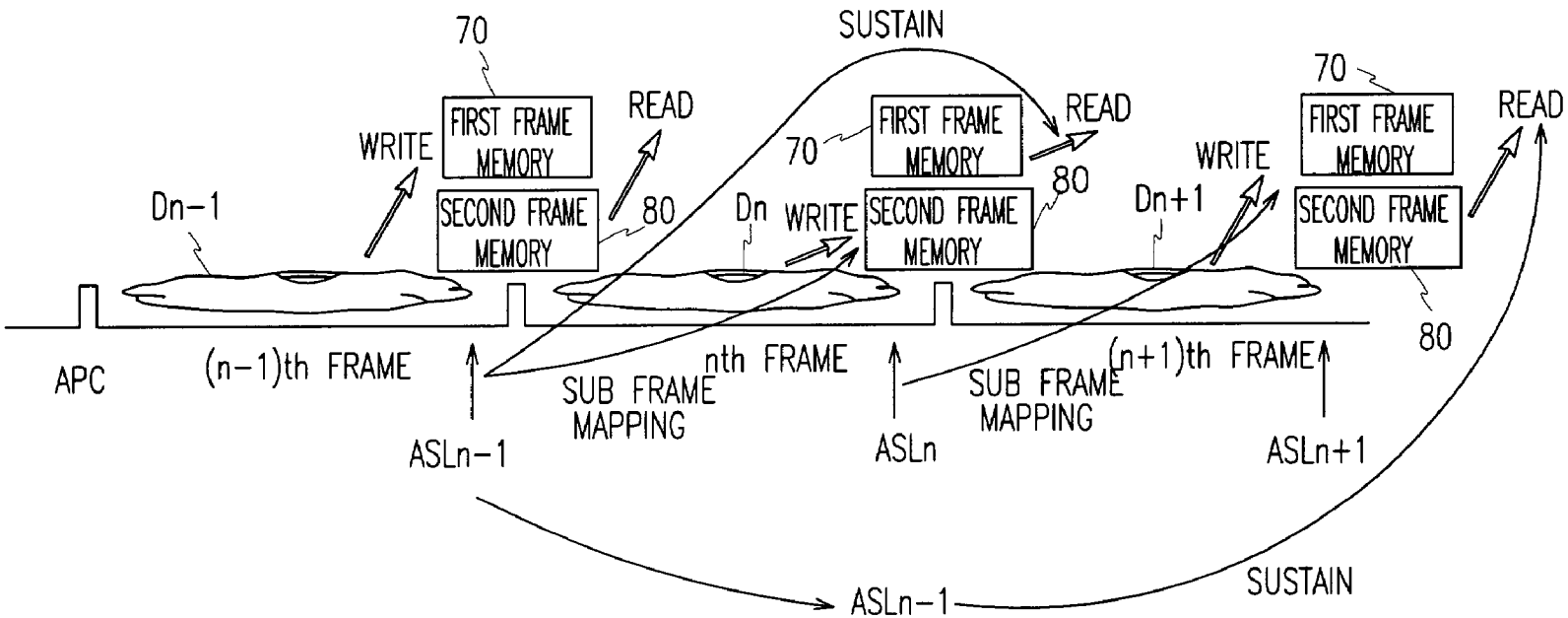
FIG. 7 schematically shows that the number of sub-fields is controlled in the method for displaying gray scales using the variable sub-field method in the PDP according to the embodiment of the present invention.

As shown in FIGS. 6 and 7, in a (n−1)th field, (n−1)th field data $D_{n-1}$ is sub-field mapped by the ASL (not shown) of (n−2)th field data by the automatic power controller 120 and the sub-field generator 60, and is input to the first frame memory 70. The ASL of the (n−1)th field data $D_{n-1}$, that is, $ASL_{n-1}$, is determined by the automatic power controller 120 at the point of time when the input of (n−1)th field data $D_{n-1}$ is completed. $ASL_n$, that is, the ASL of the nth field data $D_n$, and $ASL_{n+1}$, that is, the ASL of the (n+1)th field data $D_{n+1}$ are determined by the method used for determining the $ASL_{n-1}$.

The ASL controller 130 (from FIG. 5) compares the number of sub-fields that is determined by the ASL of previous field data with the number of sub-fields that is determined by the ASL of the current field, and outputs the number of sub-fields that is determined by the ASL of the previous field data when the number of sub-fields that is determined by the ASL of the previous field data is not equal to the number of sub-fields that is determined by the ASL of the current field. Therefore, in FIG. 6, when it is assumed that the number of sub-fields that is determined by the ASL of the (n−1)th field data $D_{n-1}$, that is, the $ASL_{n-1}$, is equal to the number of sub-fields that is determined by the ASL of the nth field data $D_n$, that is, the $ASL_n$, the ASL controller 130 outputs the number of sub-fields that is determined by the ASL of the nth field data $D_n$, that is, the $ASL_n$, in the (n+1)th field, to the sustain scan pulse generator 100.

From the point of view of the sustain scan pulse generator 100, as in the conventional technology, when the number of sub-fields that is determined by the ASL of the previous field data is equal to the number of sub-fields that is determined by the ASL of the current field, the number of sub-fields input to the sustain scan pulse generator 100 is equal to that of the conventional technology.

However, as shown in FIG. 7, if the number of sub-fields that is determined by the ASL of the (n−1)th field data $D_{n-1}$, that is, the $ASL_{n-1}$, is different from the number of sub-fields that is determined by the ASL of the nth field data $D_n$, that is, the $ASL_n$, the ASL controller 130 does not output the number of sub-fields that is determined by the ASL of the nth field, that is, the $ASL_n$, in the (n+1)th field to the sustain scan pulse generator 100, but instead outputs the number of sub-fields that is determined by the previous field that is the ASL of the (n−1)th field data $D_{n-1}$, that is, the $ASL_{n-1}$, to the sustain scan pulse generator 100.

Therefore, in the case of the nth field data $D_n$, where the sustain operation is performed in the (n+1)th field, the sustain operation is performed on the data sub-field mapped according to the number of sub-fields that is determined by the ASL of the (n−1)th field data $D_{n-1}$, that is, the $ASL_{n-1}$, according to the number of sub-fields that is determined by the ASL of the nth field data $D_n$, that is, the $ASL_n$, in the conventional technology. Accordingly, the flickering and the pseudo-outline are generated. However, in the present embodiment, the sustain operation is performed on the data sub-field mapped according to the number of sub-fields that is determined by the ASL of the (n−1)th field data $D_{n-1}$, that is, the $ASL_{n-1}$, according to the number of sub-fields that is determined by the ASL of the (n−1)th field data $D_{n-1}$, that is, the $ASL_{n-1}$, and controlled and output by the ASL controller. As a result, the data is sub-field mapped and the sustain operation is performed on the data according to the same number of sub-fields. Accordingly, the flickering and the pseudo-outline are not generated.

The above example, where 10 sub-fields are mapped when the ASL is 33 and 11 sub-fields are mapped when the ASL is 34, will now be described with reference to FIGS. 8 and 9.

Figure 8:
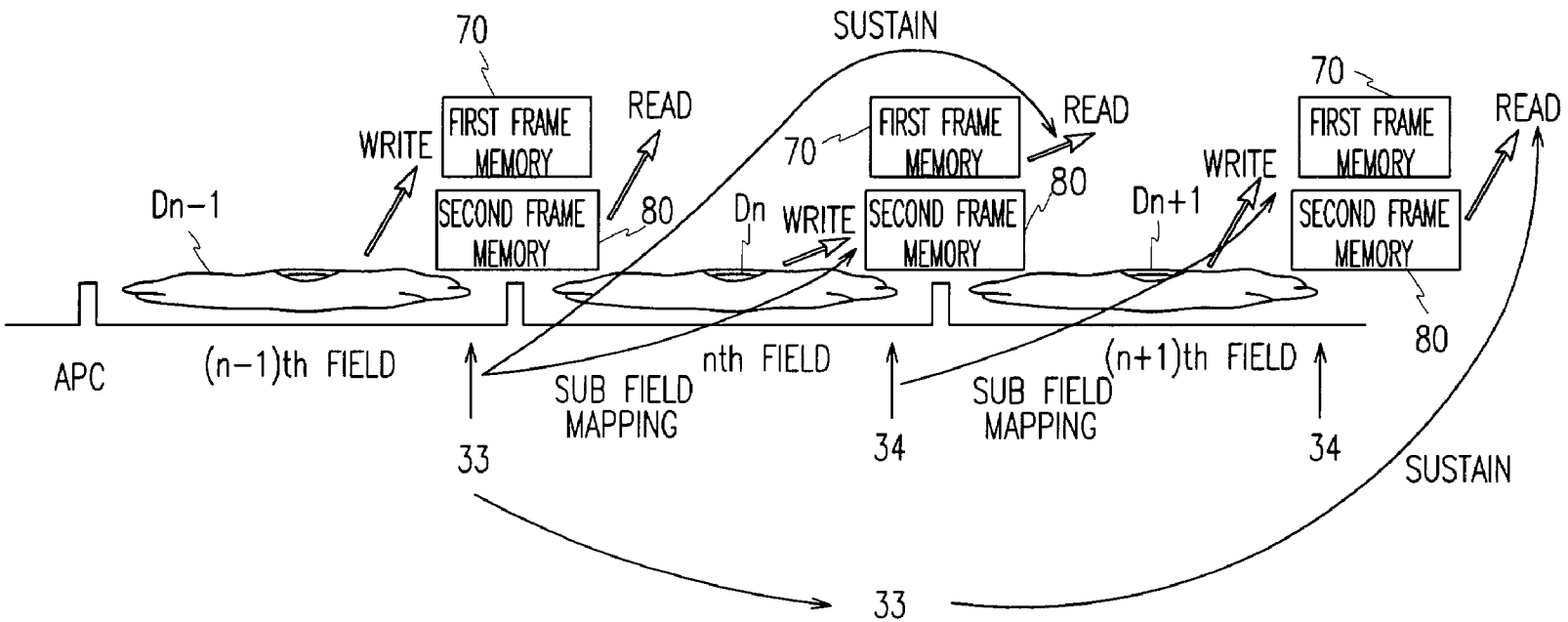
FIG. 8 schematically shows an example where the number of sub-fields is controlled in the method for displaying gray scales using the variable sub-field method in the PDP according to an embodiment of the present invention.

As shown in FIG. 8, it is assumed that the ASL of the (n−1)th field data $D_{n-1}$ is 33, that the ASL of the nth field data $D_n$ is 34, that 10 sub-fields are mapped when the ASL is 33, and that 11 sub-fields are mapped when the ASL is 34.

In this case, the nth field data $D_n$ with 10 sub-fields is mapped and stored in the second frame memory 80 by the sub-field generator 60 due to the ASL of the (n−1)th field data $D_{n-1}$, that is, 33, being output to the address data generator 90 in the (n+1)th field and being provided to the PDP 110.

Because the number of sub-fields, that is, 11, which is determined by the ASL of the nth field data $D_n$, that is, 34, which is output from the automatic power controller 120, is different from the number of sub-fields, that is, 10, which is determined by the ASL of the previous field data that is the (n−1)th field data $D_{n-1}$, that is, 33, the ASL controller 130 ignores the number of sub-fields, that is, 11, which is determined by the ASL of the nth field data $D_n$, and outputs the number of sub-fields, that is, 10, which is determined by the ASL of the (n−1)th field data $D_{n-1}$, that is, 33, to the sustain scan pulse generator 100.

The sustain scan pulse generator 100 outputs the sustain scan pulse with 10 sub-fields to the PDP 110. The 10 sub-fields are output from the ASL controller 130.

Therefore, the moment the address data with 10 sub-fields applied to the PDP 110 is provided by the second frame memory 80, the number of sub-fields sustained by the sustain scan pulse generator 100 is 10. As a result, the number of sub-fields of the address data is equal to the number of sub-fields sustained by the sustain scan pulse generator 100. Accordingly, the flickering and the pseudo-outline are not generated.

Figure 9:
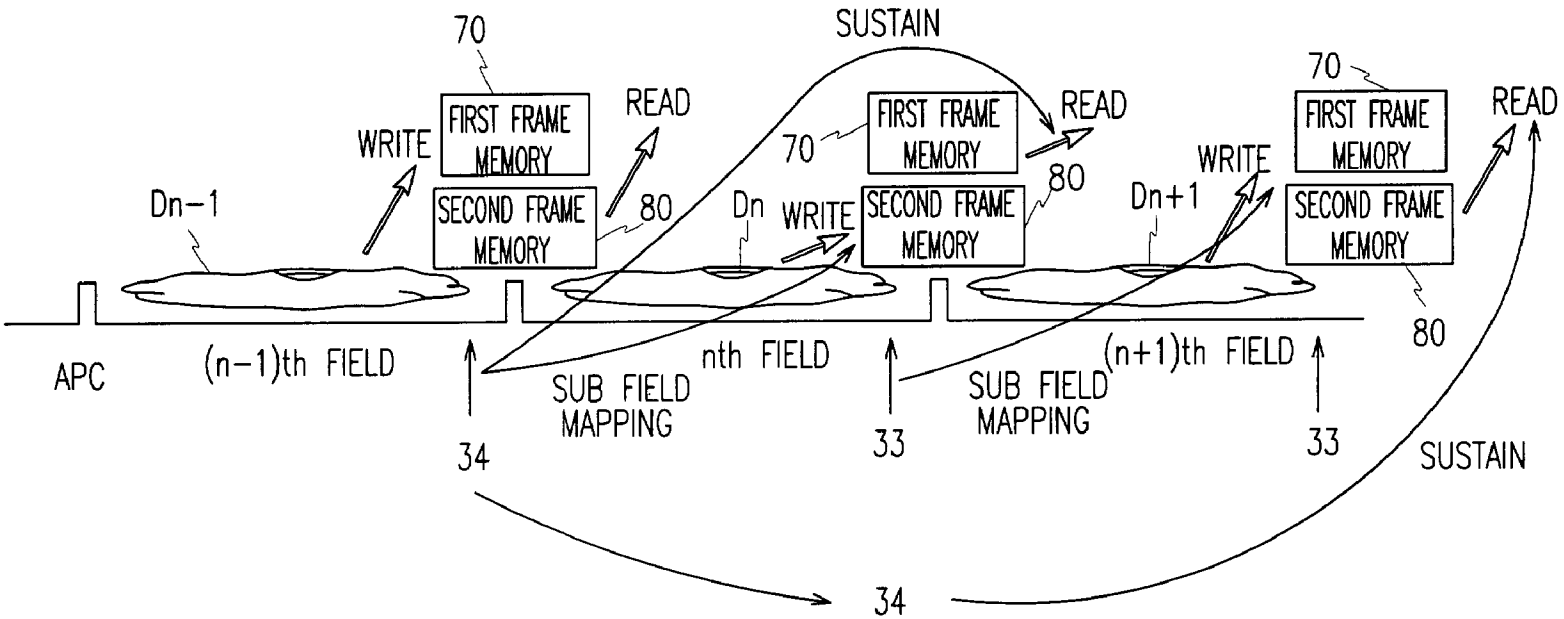
FIG. 9 schematically shows another example where the number of sub-fields is controlled in the method for displaying gray scales using the variable sub-field method in the PDP according to the embodiment of the present invention.

To the contrary, with reference to FIG. 9, when the ASL of the (n−1)th field data $D_{n-1}$ is 34 and the ASL of the nth field data $D_n$ is 33, 11 sub-fields are mapped in the second frame memory 80 and 11, that is, the number of sub-fields, which is determined by the ASL of the (n−1)th field data $D_{n-1}$, that is, 34, is output to the sustain scan pulse generator 100 by the ASL controller 130. Therefore, the 11 sub-fields are sustained. Accordingly, the flickering and the pseudo-outline are not generated.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

According to the present invention, it is also possible to control the number of sub-fields using a high correlation between video signal frames, to thus remove the flickering and the pseudo-outline. Also, it is possible to avoid using a field memory for detecting the ASL of the video data, to thus reduce expenses.

What is claimed is:

1. An apparatus for displaying gray scales of a plasma display panel (PDP), by which gray scales are displayed by arranging a plurality of sub-fields having brightness weights in the order of time and the number of sub-fields is determined according to an average signal level (ASL) of video data, the apparatus comprising:

an automatic power controller for detecting an ASL in each field of video data;

first and second memories for storing the video data in even frames and odd frames;

a sub-field generator for mapping the video data output from the automatic power controller according to the number of sub-fields that is determined by the ASL detected by the automatic power controller, generating corresponding gray scale data, and selectively storing the gray scale data in the first and second memories;

an address data generator for generating address data corresponding to the gray scale data output from the sub-field generator and applying the address data to the PDP;

an ASL controller for comparing the number of sub-fields that are determined by the ASL in a current field from the automatic power controller with the number of sub-fields that are determined by the ASL in a previous field from the automatic power controller, and controlling the output number of sub-fields; and a sustain scan pulse generator for receiving the number of sub-fields that is controlled by and output from the ASL controller, generating corresponding sustain pulses and scan pulses, and applying the sustain pulses and scan pulses to the PDP, wherein the sub-field generator maps the video data of the current field according to the number of sub-fields that is determined by the ASL of the previous field video data, and stores the video data of the current field in either the first memory or the second memory, and wherein the ASL controller compares the number of sub-fields corresponding to the ASL of the current field with the number of sub-fields corresponding to the ASL of the previous field, outputs the number of sub-fields corresponding to the ASL of the current field to the sustain scan pulse generator when the number of sub-fields corresponding to the ASL of the previous field is equal to the number of sub-fields corresponding to the ASL of the current field, and outputs the number of sub-fields corresponding to the ASL of the previous field to the sustain scan pulse generator when the number of sub-fields corresponding to the ASL of the previous field is different from the number of sub-fields corresponding to the ASL of the current field.

2. A method for displaying gray scales of a plasma display panel (PDP), by which gray scales are displayed by arranging a plurality of sub-fields having brightness weights in the order of time and the number of sub-fields is determined according to an average signal level (ASL) of video data, the method comprising:

(a) detecting the ASL of the video data of the current field;

(b) mapping the video data of the current field according to the number of sub-fields that is determined by the ASL of the previously detected video data of a previous field, and storing the video data of the current field;

(c) comparing the number of sub-fields that is determined by the ASL of the video data of the current field with the number of sub-fields that is determined by the ASL of the video data of the previous field, and controlling the output number of sub-fields; and (d) applying the video data of the current field, which are stored in the step (b), to the PDP and generating sustain scan pulses according to the number of sub-fields, which is controlled in the step (c), and applying the sustain scan pulses to the PDP at the same time, wherein in the step (c), the number of sub-fields that is determined by the ASL of the video data of the current field is output when the number of sub-fields that is determined by the ASL of the video data of the previous field is equal to the number of sub-fields that is determined by the ASL of the video data of the current field, and the number of sub-fields that is determined by the ASL of the video data of the previous field is output when the number of sub-fields that is determined by the ASL of the video data of the previous field is different from the number of sub-fields that is determined by the ASL of the video data of the current field.

* * * * *